US006206805B1

(12) United States Patent
Helton et al.

(10) Patent No.: US 6,206,805 B1
(45) Date of Patent: Mar. 27, 2001

(54) STEP FOR EXERCISING

(76) Inventors: Kimberly J. Helton; George E. Helton, Jr., both of 2700 SE. 2nd Ct., Pompano Beach, FL (US) 33062

( * ) Notice: Subject to any disclaimer, the term of this patent is extended or adjusted under 35 U.S.C. 154(b) by 0 days.

(21) Appl. No.: 09/138,457

(22) Filed: Aug. 21, 1998

Related U.S. Application Data

(63) Continuation-in-part of application No. 08/689,604, filed on Aug. 12, 1996, which is a continuation of application No. 08/463,919, filed on Jun. 5, 1995, now abandoned, which is a continuation-in-part of application No. 08/317,921, filed on Oct. 4, 1994, now abandoned.

(51) Int. Cl.[7] ..... A63B 21/00
(52) U.S. Cl. ..... 482/52; 40/605
(58) Field of Search ..... 482/52; 40/605, 40/552; 4/254; D25/65; D6/5

(56) References Cited

U.S. PATENT DOCUMENTS

D. 192,218 * 2/1962 Forsman ..... D25/65
D. 238,038 * 12/1975 Turco ..... D6/199
D. 268,796 * 5/1983 Kola ..... D6/5
D. 402,045 * 12/1998 Lougee ..... D25/65
2,023,901 * 12/1935 Rhodes ..... 4/254
3,886,676 * 6/1975 Alfonso ..... 40/60
4,244,064 * 1/1981 Parr ..... 4/254
5,540,642 * 7/1996 Sprague ..... 482/52
5,743,831 * 4/1998 Jakich ..... 482/52

FOREIGN PATENT DOCUMENTS

2044506 * 10/1980 (GB) ..... 40/552

* cited by examiner

*Primary Examiner*—Jerome Donnelly
(74) *Attorney, Agent, or Firm*—Malin, Haley & DiMaggio, P.A.

(57) ABSTRACT

An exercising stepping platform using stepping motion of the user, said exercising device comprising an enlarged hexahedronal body having a plurality of top surfaces for standing thereon and a central recessed portion for stepping down into, allowing the user to step from all sides and inside the device to the upper supported rigid body walls. the top surface may include a non-skid portion to prevent slippage.

5 Claims, 7 Drawing Sheets

STEP FOR EXERCISING

CROSS-REFERENCE TO RELATED APPLICATIONS

This invention is a continuation-in-part of Ser. No. 08/689,604, filed Aug. 12, 1996, now abandoned, which is a continuation of Ser. No. 08/463,919, filed Jun. 5, 1995, now abandoned, which is a continuation-in-part of Ser. No. 08/317,921, filed Oct. 4, 1994, now abandoned, with each application being incorporated herein by reference.

STATEMENT REGARDING FEDERALLY SPONSORED RESEARCH OR DEVELOPMENT

N/A.

BACKGROUND OF THE INVENTION

1. Field of the Invention

This invention relates generally to an exercising device based on principles of a single step platform, and specifically, to an improved exercising stepping platform device that allows for numerous activities using the stepping motion as the basic exercise source by providing directional platform stability for performing forward, backward, and lateral stepping movements from a multitude of different positions, safely and conveniently.

2. Description of Related Art

The use of indoor exercising equipment is well known in today's health-conscious world. Aerobic exercising devices in particular have been used. Of popular usage is a device that basically functions as a single step that typically is square, having one raised platform or surface, somewhat elastic, that allows a person to begin a series of step up and step down motions from the floor. While these devices work quite well, they are somewhat limited in the range of action permitted athletically and aerobically, due to its confined size and area configuration. The user cannot vary the exercise motion in the stepping action presented because there is only a single area available to be stepped on.

BRIEF SUMMARY OF THE INVENTION

A raised stepping platform supported on the ground comprising, in a first embodiment, a rigid hexahedronal-shaped body having an elevated horizontal top surface substantially rectangular in perimeter shape and sized in area to receive the feet of a person using the device on all elevated horizontal top surface portions, the raised platform having a vertical central interior hollow area forming a vertical passage to the floor that also functions to allow one to step down into the center passage area therein while performing aerobic step up and step down exercises.

The platform body has a top flat horizontal surface, divisible into four surface sections, elevated to the height of a conventional human step, four exterior vertical side walls perpendicular to the floor and a bottom flat horizontal surface that contacts the floor and is attached to the exterior side walls. The hollow central interior passage also has four interior vertical walls perpendicular to the floor. The hexahedronal body includes peripheral rounded, vertical corners for smoothness and safety and includes substantially rectangular individual exterior side walls, all of which are connected together to form a hexahedron, with a hollow central portion. The interior hollow central passage of the body is sized in length and width (and may be also square) to permit sufficient volume and area where the user may at least plant two feet on the ground within the central hollow area with some space left over to permit active and vigorous step up and step down motions with one or two feet within the central hollow area.

The length and width of the hexahedronal body may each be approximately four feet with the top platform surface area sized for a person to safely stand on all four sides around the hollow passage, being sufficiently wide on each top horizontal surface portion (between the exterior vertical wall and the interior vertical wall) of the device to accommodate both feet of the user while the entire device remains stable. The top surface flat horizontal area surrounding the interior vertical passage on all sides is approximately the same area size to allow receiving the length and width of two human feet laterally and longitudinally during exercise motions. The height of the platform from the floor is from 7 inches to 9 inches for best results.

The hexahedronal body itself may be made of a rigid, polypropylene plastic or plastic foam material that is sufficiently rigid to support an adult, large person standing on the top surface of the platform.

In addition, a top horizontal thin layer of a rubber or rubber-like high friction material is adhesively glued to the top flat horizontal surface of the device so that stepping on and off the device will be safely done without slipping because of the non-skid or non-slip type top surface.

The dimensions of the body and the configuration and shape (inside and out) is important to the overall operability and suitability for extensive aerolic exercises. The overall top plan shape is that substantially of a rectangular polygon with square or rectangular interior vertical central passage all the way through. The top body horizontal platform is essentially four rectangular top surfaces, joined end-to-end, each of which must be sufficiently sized to comfortably and safely receive both feet of a person while the body remains stable and sized so that the top surface walls are not so thin that one might easily trip or fall off.

The inside hollow interior vertical passage must be large enough in length and width to also receive both feet of the user with extra space to allow for active stepping movement in all directions.

The volumetric size of the interior vertical passage could be varied by an insert block that itself has an interior vertical passage for use with smaller persons.

The height of the device can be varied, depending on how tough or stringent the exercising will be, but should be somewhere in the range of six to eight inches for average usage.

The device could be constructed with hinges or sections that lock together for storage purposes.

In an alternate embodiment, the central interior vertical passage that would be entirely through the body of the device so that the floor is exposed could be modified in depth so that a small central portion remains, altering the overall height of the vertical step or the depth of the passage from the top surface to a bottom surface raised slightly above the floor.

In yet another alternate embodiment, the central passage of the device might be replaced by a raised stair protrusion that instead of having a hollow passage in the same area portion in the central part of the device, could have substantially another hexahedronal-shaped body that is raised and elevated above the top surface of the device even higher, adding another step in the center of the device. The step height again could be anywhere from 6 to 8 or 9 inches as desired. This would be a rigid body portion so that the entire structure could be substantially rigid and have, in effect, two raised upper surface platforms, one in the center higher than the peripheral to allow double stepping motion from the floor to the lower horizontal platform which would be one step high, and then to another higher step position that can support the weight of a human being sized in horizontal length and width to comfortably accommodate the feet of the user. In this alternate embodiment, the body of the platform provides a double step, measured from the floor to the center of the platform while still allowing the user lateral, forward, and backward movements relative to the central step. The center step is (from a top plan view) sized in length and width to be substantially a 22 inch square with the overall outside periphery of the platform being 4 feet by 4 feet.

In a preferred embodiment, the hexahedronal-shaped body includes a removed perimeter side member to form a U-shaped body. A user thus can gain access to the central hollow interior through the removed perimeter side member.

The preferred U-shaped body embodiment is divisible in three surface sections, elevated to the height of a conventional human step, three exterior vertical side walls perpendicular to the floor and a bottom flat horizontal surface that contacts the floor and is attached to the exterior side walls. The hollow central interior passage also has three interior vertical walls perpendicular to the floor. The U-shaped body can include peripheral rounded, vertical corners for smoothness and safety and includes substantially rectangular individual exterior side walls, all of which are connected together to form a U-shape, with a hollow central portion. The interior hollow central passage of the body is sized in length and width (and may be also square) to permit sufficient volume and area where the user may at least plant two feet on the ground within the central hollow area with some space left over to permit active and vigorous step up and step down motions with one or two feet within the central hollow area.

The width of the U-shaped body may each be adjustable to accommodate users of varying size, and to permit additional exercise surface area.

It is an object of this invention to provide an improved athletic stepping device for increasing the range of aerobic and athletic activities available for exercising.

It is another object of this invention to provide a non-complex structural exercising device that allows for increased exercising activities.

And yet still another object of this invention is to provide an aerobic stepping device for exercising for a person that allows a plurality of stepping actions safely and efficiently.

In accordance with these and other objects which will become apparent hereinafter, the instant invention will now be described with particular reference to the accompanying drawings.

DETAILED DESCRIPTION OF THE INVENTION

Figure 1:
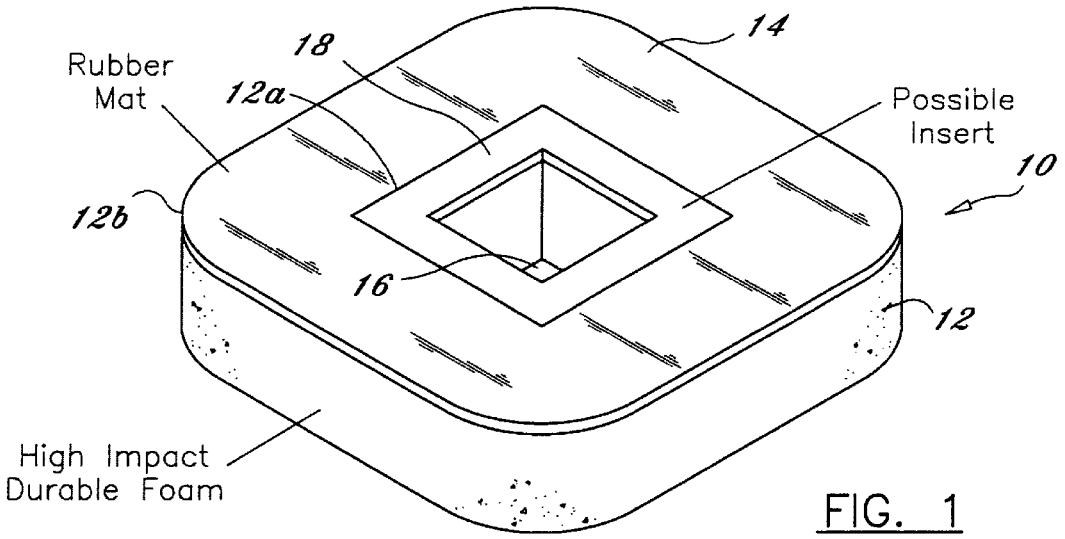
FIG. 1 shows a perspective view of one embodiment of the present invention.
Figure 2:
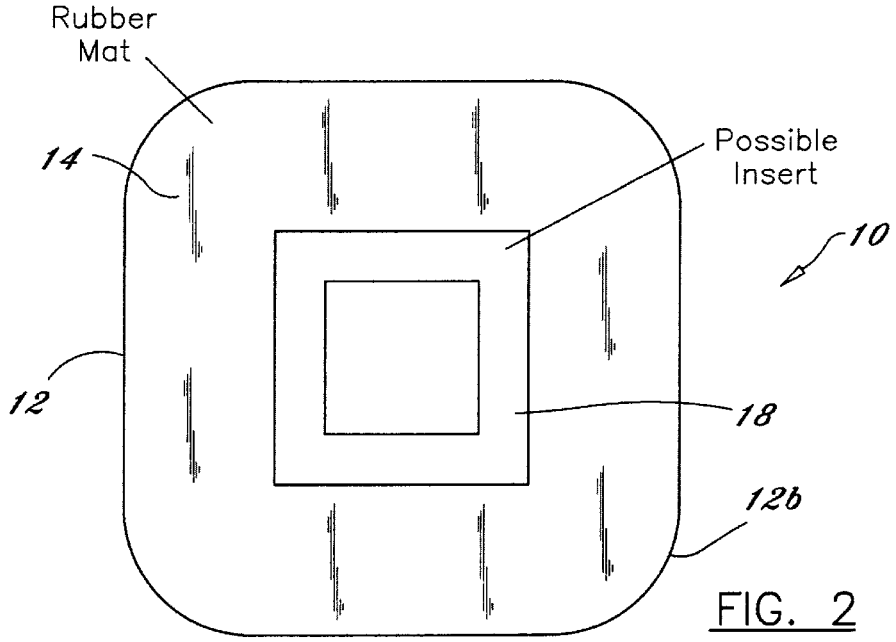
FIG. 2 shows a top plan view of the embodiment of FIG. 1.
Figure 3:
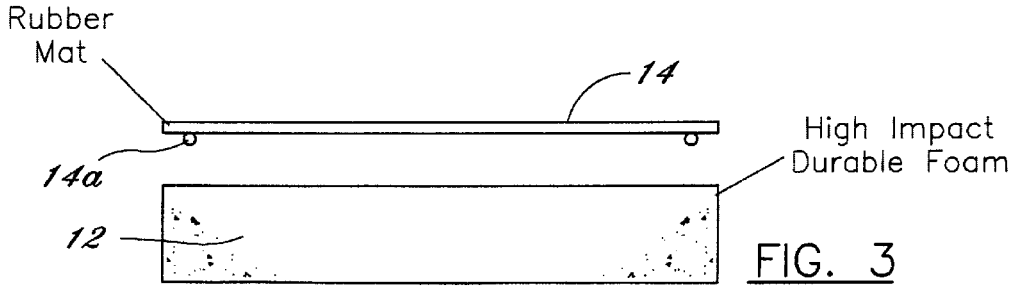
FIG. 3 is a side elevational view, exploded of FIG. 1.

Referring now to the drawings, and in particular FIG. 1, the present invention is shown generally as platform 10 comprised of an enlarged hexahedronal, rigid body 12 made of a rigid plastic material of polypropylene or rigid styrofoam plastic, having four exterior vertical walls sturdy enough to support a large human being standing on the top surface. The top surface of the polygon rigid body 12 is covered with a non-skid rubber or rubber-like thin layer 14 by a suitable adhesive (not shown) so that a person can stand on the non-skid layer 14 without slipping. A rectangular or square central interior vertical passage area is hollow and is defined by four interior vertical walls 12*a* around the inside periphery of the body 12, forming a recessed hollow portion 16 that goes through the entire body to the ground or floor. The inside four-walled portion formed by walls 12*a* is sized in length and width to comfortably accommodate both feet of a user in a standing position facing all four directions around the device inside.

The peripheral outside vertical corners, top and bottom, may be rounded in shape for safety to prevent projecting orthogonal corners that may harm a user.

The top flat horizontal surface, represented by the non-skid 14 on each side wall, must be sized in length and width to accommodate the full length of a person's foot and both feet side-by-side, regardless of the direction that the feet are facing, so that the device can be used in all four directions while stepping inside or outside of the device. Thus, the top surface widths should be at least fourteen to sixteen inches from the outside vertical wall 12 to the inside vertical wall 12*a*.

In the preferred configuration, the total length of an outside vertical wall 12 is approximately four feet. The inside vertical walls in length are 16 inches. The height of all walls are approximately six to eight inches, as desired.

To utilize the exercising device, the user positions the device on a sturdy surface, such as a floor. The device is approached as a stepping device for all four top horizontal surfaces and the inside vertical passage can accommodate both feet while facing in any direction. Based on this configuration, a wide range of body movements and stepping actions, both stepping up and stepping down, are greatly enhanced. For example, a user can start from the inside and step up either left or right on each side of the device, or use continuous motion from left to right, or from front to back. Likewise, the user can step across to the other side so that the legs are separated and begin stepping actions with either leg from that position, sideways or forward or backwards.

The available top surface area of the platform can be altered by having a center vertical hexahedronal insert 16 to change the top surface platform area and the area size of the interior vertical passage to accommodate users of different sizes. However, the overall length and width of the invention can be varied to different sizes for small, medium, and large people. The insert 16 also is made of a rigid, sturdy material and includes its own passage 16*a* to allow the user to stand inside.

Figure 4:
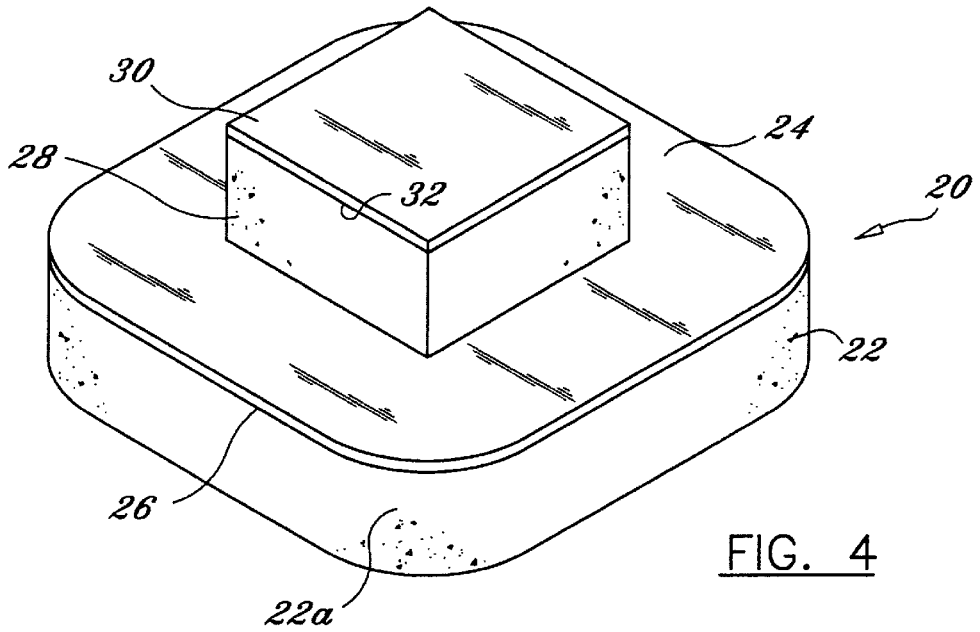
FIG. 4 shows a perspective view of an alternate embodiment of the present invention.

FIG. 4 shows an alternate embodiment of the invention in which the central hollow interior vertical passage previously provided for a step down is replaced by a rigid vertical raised step 28 that is formed as a solid part of body 22 which includes upper horizontal surface non-skid mat 24 mounted on top of body 22, with the non-skid mat 24 attached to the upper surface of body 22 by suitable adhesive 26. Again, the peripheral corners of the body 22 are rounded, such as shown at 22*a*, for safety purposes. The horizontal surface area, covered by the non-skid upper mat 24, is sized so that a person could safely and comfortably stand anywhere on the surface area having both feet pointing in lateral or longitudinal directions. The raised step 28 has a non-skid mat 30 attached to the top surface and is sized to receive human feet comfortably. In this embodiment, the top step is approximately 22 inches in length and 22 inches in width horizontally. The overall dimensions of the body 22 is approximately 4 feet by 4 feet, and the step height would be from approximately 6 to 9 inches for the first step, and also approximately 6 to 9 inches for higher step 28. The advantage of the embodiment shown in FIG. 4 is that the user can again achieve great exercising motions in both longitudinal and lateral movements forward, backward, and sideways, using the first platform 24 lower surface and the second upper platform surface 30 to achieve numerous different movements, beginning from the floor to the first platform level 24 to the second level 30. Note, while the user is standing on the raised step 28 and upper surface 30. The user can step either forward, backwards, or sideways. This motion can continue down to the floor from the medium platform. In construction, the entire device may be made from one solid unit with the raised step 28 firmly and rigidly attached thereto to allow it to support a human being standing on the top horizontal non-skid surface 30.

Figure 5:
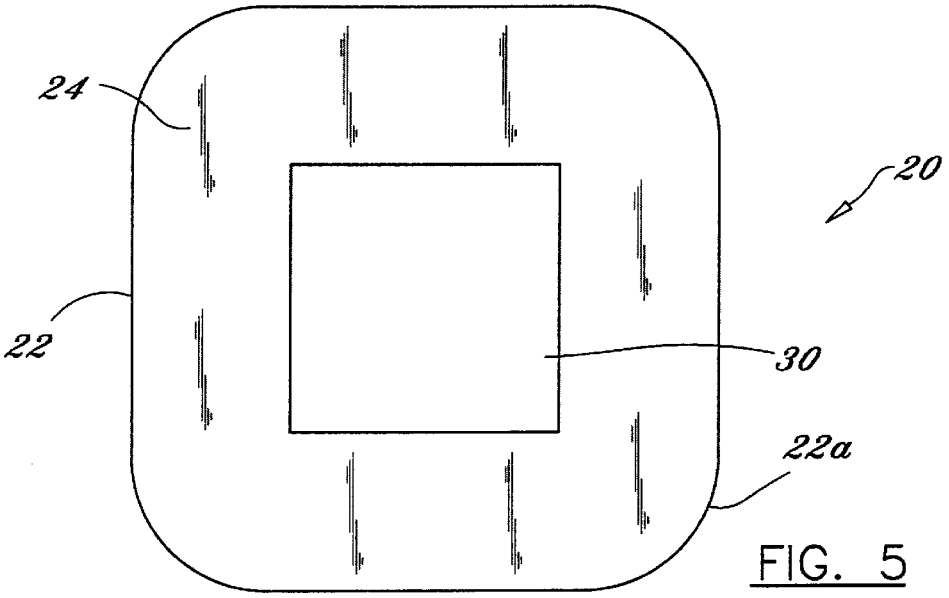
FIG. 5 shows a top plan view of the alternate embodiment of the invention shown in FIG. 4.
Figure 6:
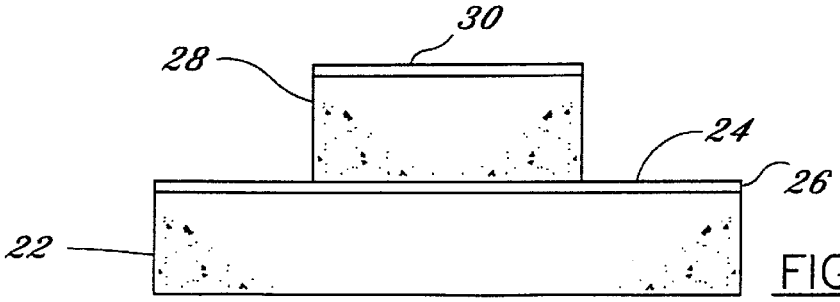
FIG. 6 shows a side elevational view of the alternate embodiment of the invention shown in FIG. 4.

FIG. 5 shows a top plan view with the rounded corners 22*a*. FIG. 6 shows a side view with adhesive 26 representing glue that attaches the non-skid top layers 24 and 30 which may be rubber or any suitable artificial material that has a friction surface or roughened surface area for contact to prevent slippage when standing on the device.

In addition to the enclosed versions of this invention, as illustrated in FIGS. 1–6, we have found that open versions of the adjacent ground stepping area can provide the desired objectives of this invention.

Examples of the open versions are illustrated in FIGS. 7–13. All of these examples have flat upper and lower horizontal surfaces and perpendicular walls, with a height in the range of four to eight inches.

Figure 7:
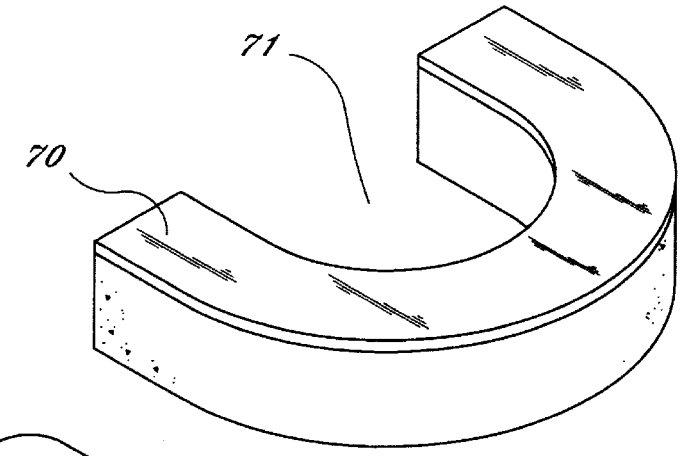
FIG. 7 is a perspective view of a rounded U-shaped device made in accordance with this invention.

The embodiment 70 illustrated in FIG. 7 is of rounded U-shape where the person doing the stepping stands in the adjacent, open stepping area 71 which has sufficient spaces so that the person can easily step on the rounded or straight sections from a standing position on the floor without being confined.

Figure 8:
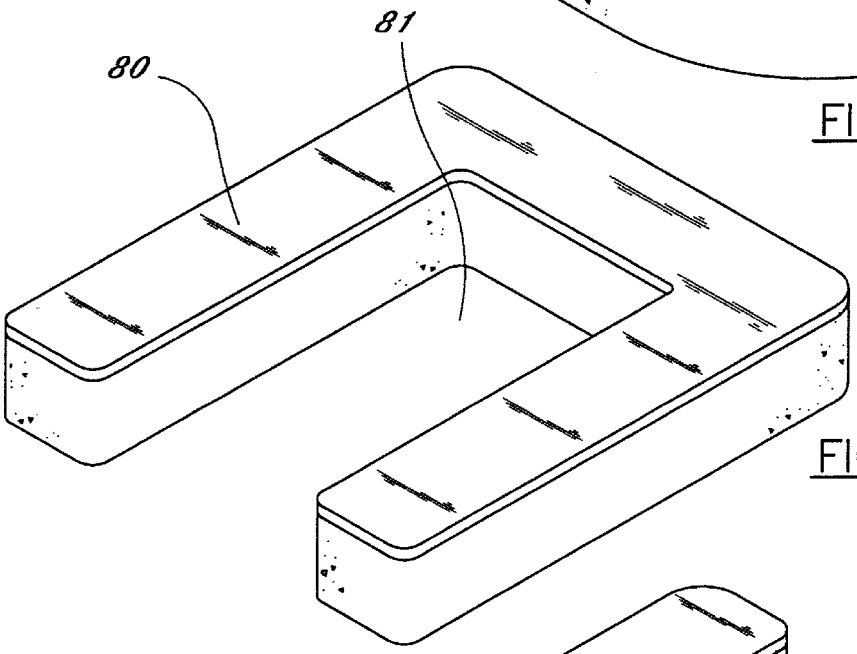
FIG. 8 is a perspective view of a rectangular U-shaped device made in accordance with this invention.

Referring to FIG. 8, the U-shaped embodiment 80 of this invention has a similar adjacent, open stepping area 81 in which the user can stand and perform the stepping exercises.

Figure 9:
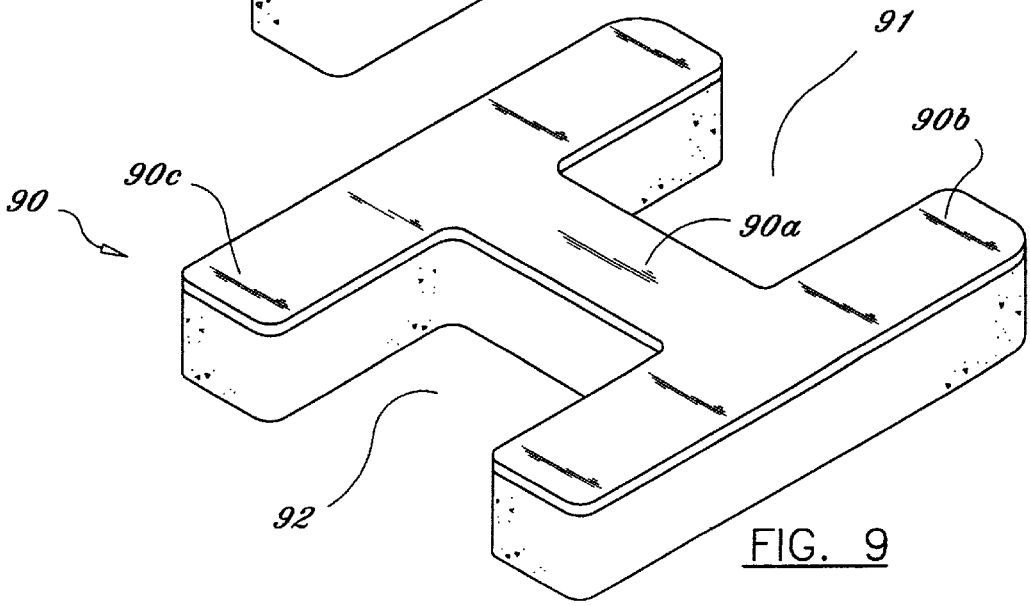
FIG. 9 is a perspective view of an H-shaped device made in accordance with this invention.

The embodiment 90 illustrated in FIG. 9 is of H-shape so that a person exercising can stand in adjacent stepping recess area 91 or 92, step up to the central top surface 90(*a*) as well as to the side surfaces 90(*b*) and 90(*c*).

Figure 10:
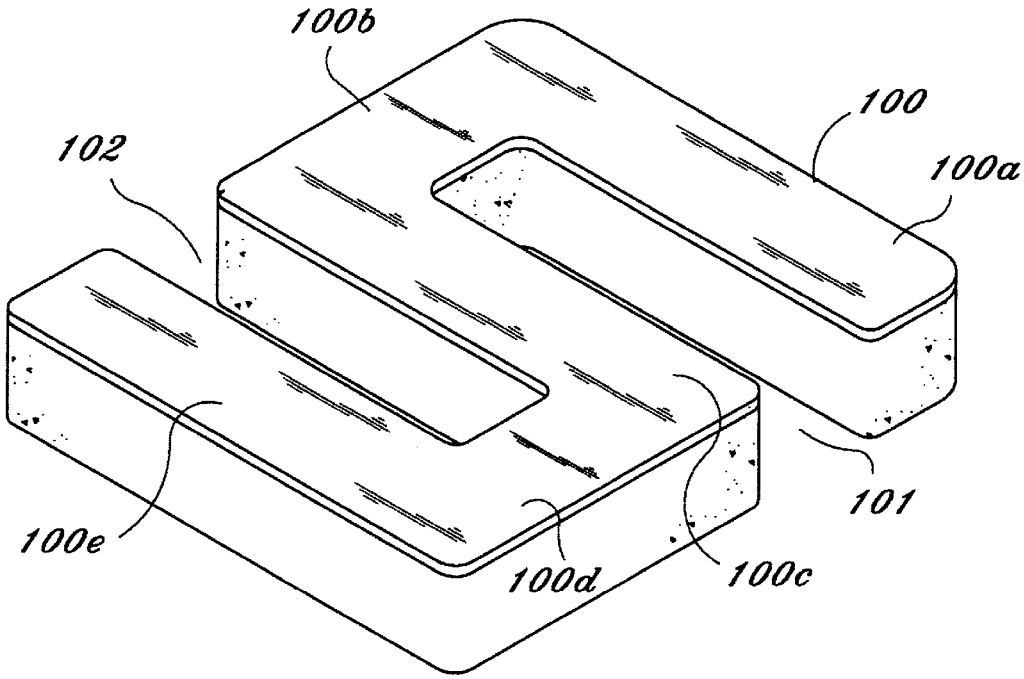
FIG. 10 is perspective view of an S-shaped device made in accordance with this invention.

The embodiment 100 illustrated in FIG. 10 is of S-shape with open adjacent stepping floor areas 101 and 102 and top segments 100(*a*) 100(*b*) 100(*c*) 100(*d*) and 100(*e*).

Figure 11:
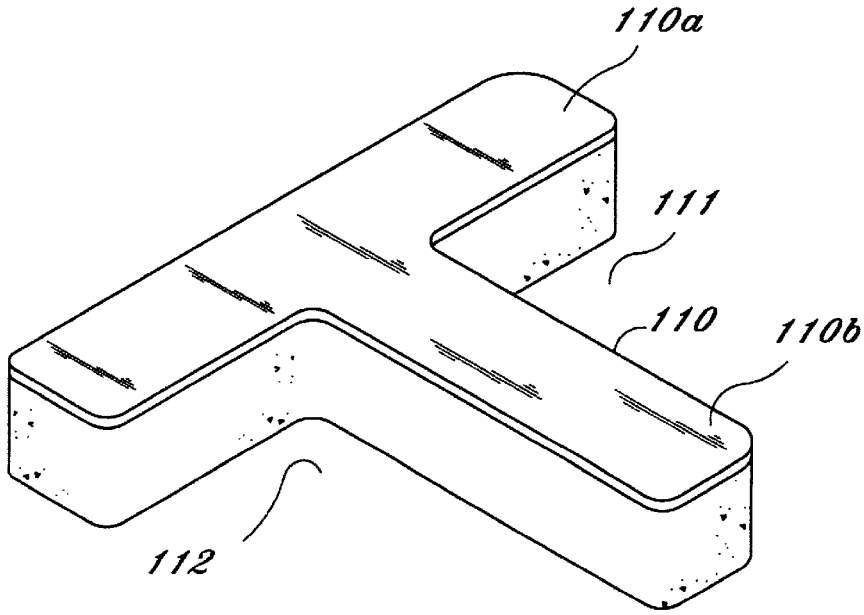
FIG. 11 is a perspective view of a T-shaped device made in accordance with this invention.

Yet another embodiment 110 of this invention illustrated in FIG. 11 is of T-shape where the cut-outs adjacent stepping areas 111 and 112 permit stepping on the segments 110(*a*) and 110(*b*).

Figure 12:
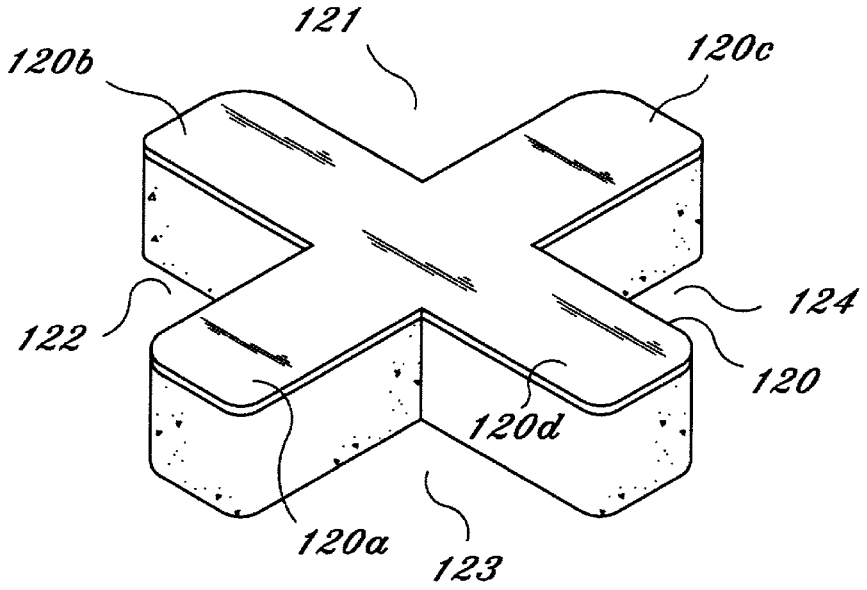
FIG. 12 is a perspective view of a cross-shaped device made in accordance with this invention.

Another arrangement 120 shown in FIG. 12 is a cross-section with segments 120(*a*), 120(*b*), 120(*c*), and 120(*d*) with adjacent stepping floor areas 121, 122, 123 and 124.

Figure 13:
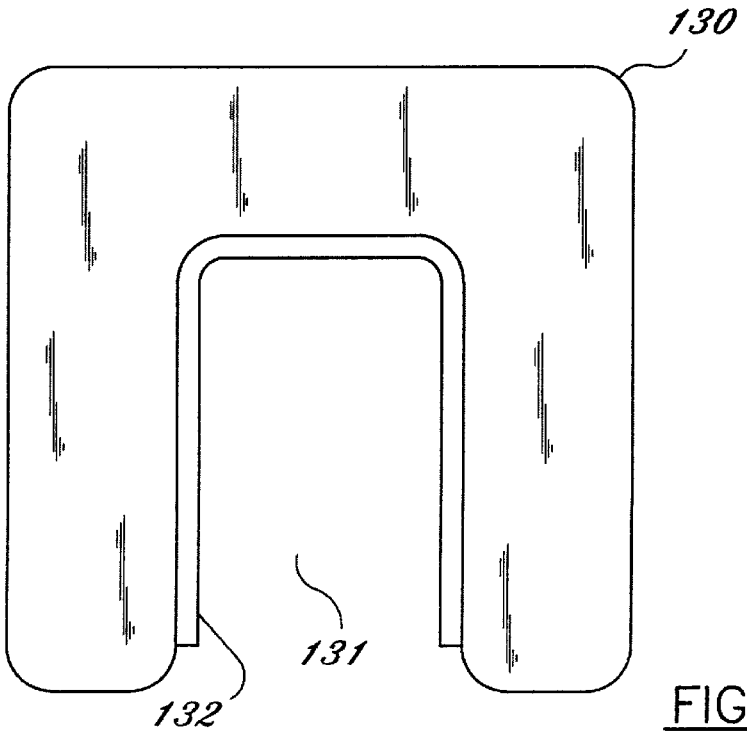
FIG. 13 is a perspective view of a rectangular U-shaped device with an optional insert for shorter people made in accordance with this invention.

The U-shaped embodiment 130 shown in FIG. 13 has a floor stepping area 131. The area can be shortened by use of an insert 132 for shorter people.

Figure 14:
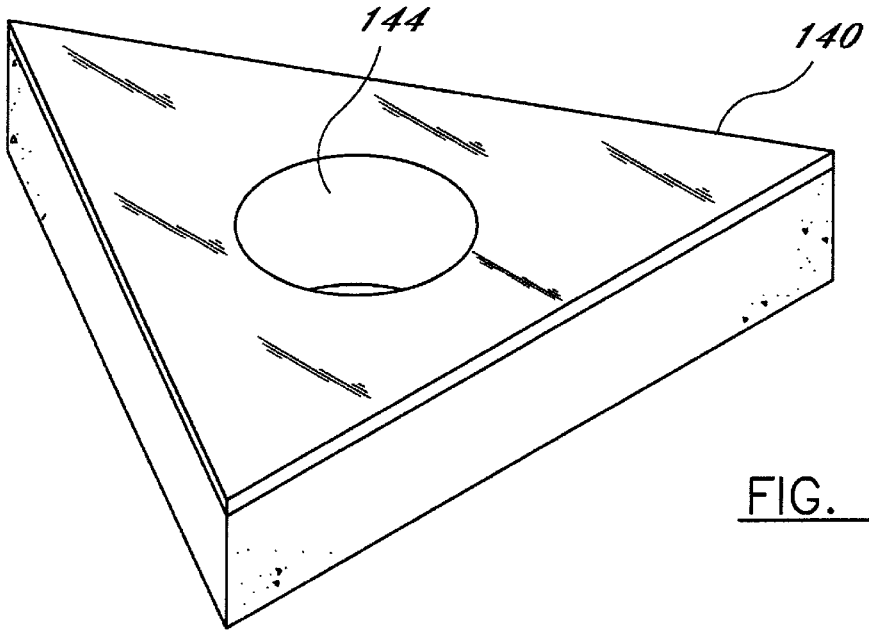
FIG. 14 is a perspective view of a triangular device with a triangular central opening made in accordance with this invention.
Figure 15:
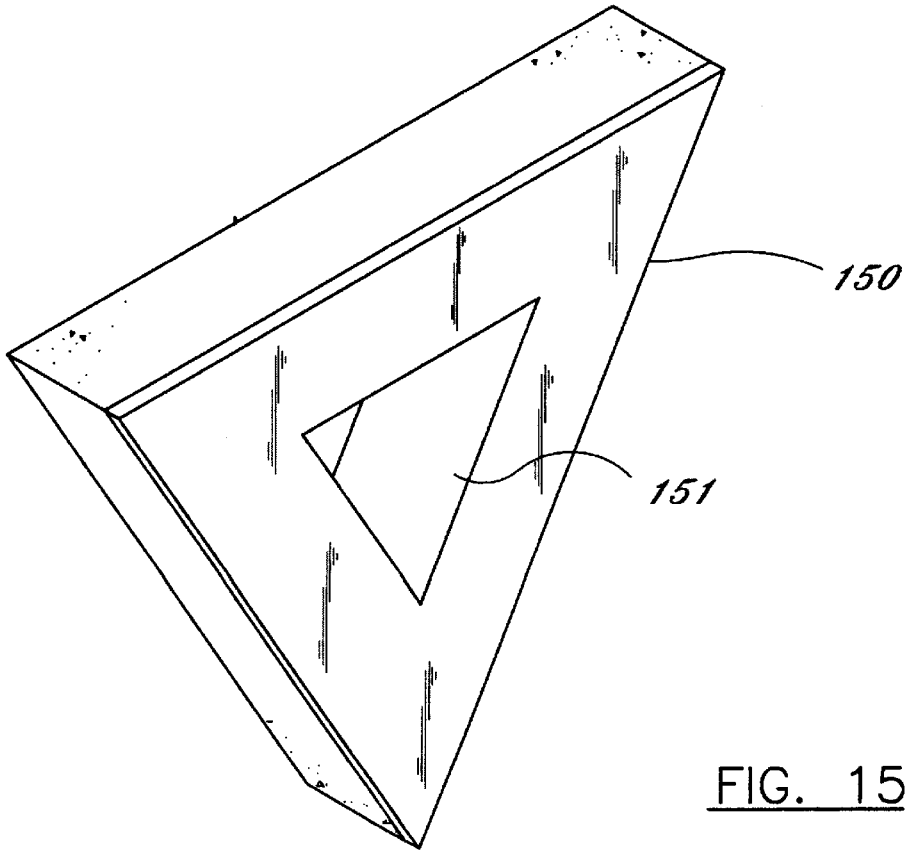
FIG. 15 is a perspective view of triangular device with a circular central opening made in accordance with this invention.

The triangular embodiment 140 shown in FIG. 14 has a central round opening for floor stepping area 144, while the triangular embodiment 150 shown in FIG. 15 has a central triangular opening for floor stepping area 151.

Figures 16, 18:
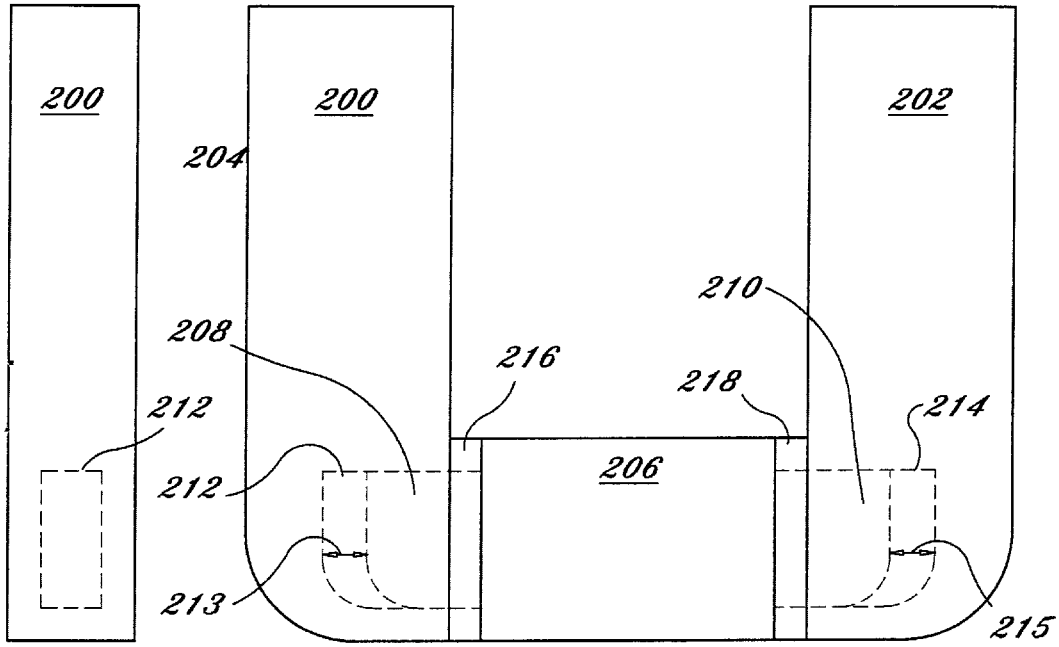
FIG. 16 is a top plan view of an alternate embodiment of that of FIGS. 8 and 13, which is adjustable in width.
FIG. 18 is a side elevational view of that of FIG. 16.
Figure 17:
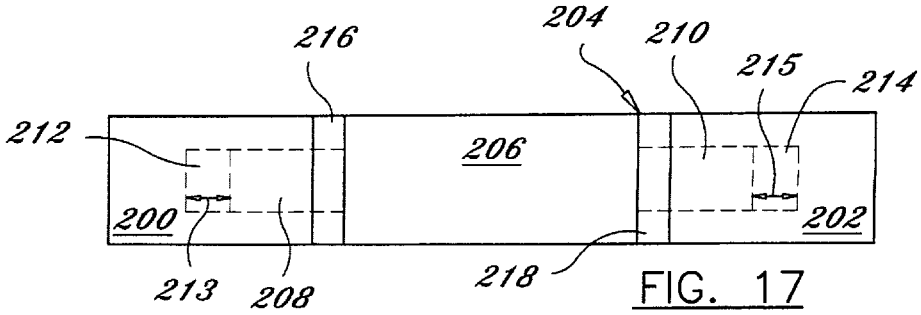
FIG. 17 is a front elevational view of that of FIG. 16.

Referring to FIGS. 16, 17, and 18, an alternate embodiment to that of FIGS. 8 and 13 is illustrated. The embodiment illustrated in FIGS. 16–18 is the preferred embodiment and is believed to be the best mode for carrying out the invention. Side members 200 and 202 are extensible outward from central opening 201 to provide a wider stepping surface 204. Side member 206, which is disposed transverse, or substantially perpendicular to, members 200 and 202, includes axially protruding arm members 208 and 210. Arm members 208 and 210 engage apertures 212 and 214, respectively, in a relatively firm manner to retain the position of side members 200, 202, and 206 in substantially U-shaped alignment. Alternately, arm members 208 and 210 can be secured within apertures 212 and 214 by suitable fasteners, including, but not limited to, screws, pins, notches, grooves, keys, hooks and loops, straps, and the like.

Removable spacer members 216 and 218 can be disposed upon arm members 208 and 210 to separate side members 200 and 202 a preselected distance apart. Spacer members 216 and 218 include central apertures sized to receive arm members 218 and 210. When in-place, spacer members 216 and 218 widen central opening 201 and widen the stepping surface 204 by the preselected width of both spacer members 216 and 218.

When spacer members 216 and 218 are removed, arm members 208 and 210 fit further into apertures 212 and 214, into the spaces defined as 213 and 215. Spaces 213 and 215 are sized according to the width of spacer members 216 and 218.

The embodiment illustrated in FIGS. 16–18 is thus adjustable in width by the removal or insertion of one or more spacer members such as 216 and 218. The device as illustrated can further be disassembled for compact storage and/or shipment.

By utilizing the present invention, the amount of stepping action available for a person desiring to exercise with the step is greatly increased. The device is sized and configured so that the body is stable and can support human weight on all upper horizontal surfaces for safely supporting the user during exercises.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An exercising stepping platform for allowing a person to step up and down from a first location on a floor to a second, raised position, said exercising platform comprising:

a rigid body having an upper substantially horizontal surface to allow a person to stand thereon, said body being rigid enough to support human weight at any position along said upper horizontal surface, said body sized in height to allow stepping action from a floor adjacent said body for a human being;

said body having a lower substantially horizontal surface adapted to rest on the floor;

said body having two substantially parallel side members connected together by a transverse side member wherein said rigid body is substantially U-shaped;

a central vertical recessed hollow portion defined by said U-shaped body sized to receive both feet of a human being facing in any direction with sufficient space for stepping out of said recessed portion;

said body having length and width dimensions sized to receive a pair of human feet on said upper substantially horizontal surface of said body that defines a U-shaped perimeter around the central recessed portion, wherein a user can step from multiple directions inside and outside of the platform for an enlarged range of human stepping actions available for exercising;

means for adjusting the width dimension of said rigid body wherein said means includes said transverse side member having at least one axially extended arm member removably disposed in an aperture defined by at least one of said two substantially parallel side members;

at least one spacer member removably disposed on said at least one extended arm member to space apart said transverse side member and at least one of said two substantially parallel side members to increase the width dimension of said rigid body;

said transverse side member includes two axially extended arm members, said arm members removably disposed in two apertures, one each of said apertures defined by one of said two substantially parallel side members; and two spacer members, one each of said two spacer members disposed between said transverse side member and one of said two substantially parallel side members.

2. A method for utilizing the exercise stepping platform of claim 1, comprising the steps of:

placing both feet within said central vertical recessed portion;

stepping upwards and outward with a first leg in a lateral direction;

placing said first leg on top of a first said side member;

stepping upwards with a second leg in an opposite lateral direction from said lateral stepping motion of said first leg;

placing said second leg on top of a second said side member such that said first and second legs straddle said recessed portion;

returning said first leg to said recessed portion;

returning said second leg to said recessed portion; and repeating said first and second leg stepping and returning motions until said first and second legs are fatigued.

3. A method for utilizing the exercise stepping platform of claim 1, comprising the steps of:

placing both feet within said central vertical recessed portion of an exercise stepping platform;

stepping forward with a first leg;

placing said first leg on top of said transverse side member;

stepping outward with a second leg in a lateral direction;

placing said second leg on top of one of said side members;

returning said first leg to said recessed portion;

returning said second leg to said recessed portion; and repeating said first and second leg stepping and returning motions until said first and second legs are fatigued.

4. A method for utilizing the exercise stepping platform of claim 1, comprising the steps of:

straddling one of said side members having inner and outer vertical sides, by placing a first leg on the floor substantially near said inner vertical side and within said central vertical recessed portion and placing a second leg substantially near said outer vertical side of said one of said side members;

stepping forward with said first leg;

placing said first leg on top of said transverse side member;

stepping inward with said second leg in a lateral direction;

placing said second leg on top of said one of said side members;

returning said first and second legs to their starting positions; and repeating said first and said second leg stepping and returning motions until said first and second legs are fatigued.

5. An exercising stepping platform for allowing a person to step up and down from a first location on a floor to a second, raised position, said exercising platform comprising:

a rigid body having an upper substantially horizontal surface to allow a person to stand thereon, said body being rigid enough to support human weight at any position along said upper horizontal surface, said body sized in height to allow stepping action from a floor adjacent said body for a human being;

said body having a lower substantially horizontal surface adapted to rest on the floor;

said body having two substantially parallel side members connected together by a transverse side member wherein said rigid body is substantially U-shaped;

a central vertical recessed hollow portion defined by said U-shaped body sized to receive both feet of a human being facing in any direction with sufficient space for stepping out of said recessed portion;

said body having length and width dimensions sized to receive a pair of human feet on said upper substantially horizontal surface of said body that defines a U-shaped perimeter around the central recessed portion, wherein a user can step from multiple directions inside and outside of the platform for an enlarged range of human stepping actions available for exercising; and means for adjusting the width dimension of said rigid body wherein said means includes said transverse side member having at least one axially extended arm member removably disposed in an aperture defined by at least one of said two substantially parallel side members.

* * * * *